US006474928B1

(12) United States Patent
Christenson

(10) Patent No.: US 6,474,928 B1
(45) **Date of Patent: *Nov. 5, 2002**

(54) LINEARLY ADJUSTABLE CONTAINER HOLDING AND LIFTING DEVICE

(75) Inventor: Ronald E. Christenson, Parsons, TN (US)

(73) Assignee: McNeilus Truck and Manufacturing, Inc., Dodge Center, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/664,593

(22) Filed: Jun. 17, 1996

(51) Int. Cl.[7] ..... B65F 3/04
(52) U.S. Cl. ..... 414/408
(58) Field of Search ..... 414/408, 409

(56) References Cited

U.S. PATENT DOCUMENTS

| | | | |
|---|---|---|---|
| 3,414,147 | A | 12/1968 | Schroering |
| 3,630,389 | A | 12/1971 | Schmidt |
| 3,841,508 | A | 10/1974 | Ebeling et al. |
| 3,894,642 | A | 7/1975 | Shive |
| 3,964,624 | A | 6/1976 | Werder |
| 3,982,782 | A | 9/1976 | Bos |
| 4,102,262 | A | 7/1978 | Liberman et al. |
| 4,108,261 | A | 8/1978 | Liberman et al. |
| 4,116,121 | A | 9/1978 | Liberman et al. |
| 4,125,196 | A | 11/1978 | Liberman et al. |
| 4,175,903 | A | 11/1979 | Carson |
| 4,227,849 | A | 10/1980 | Worthington |
| 4,239,437 | A | 12/1980 | Naab |
| 4,401,407 | A | 8/1983 | Breckenridge |
| 4,435,117 | A | 3/1984 | House |
| 4,447,185 | A | 5/1984 | Robinson et al. |
| 4,456,421 | A | 6/1984 | Robson |
| 4,461,607 | A | 7/1984 | Smith |

(List continued on next page.)

FOREIGN PATENT DOCUMENTS

| | | | | |
|---|---|---|---|---|
| SU | 1161433 | * | 6/1985 | ..... 414/408 |
| WO | WO 92/01612 | | 2/1992 | |

*Primary Examiner*—Thomas J. Brahan
(74) *Attorney, Agent, or Firm*—C. G. Mersereau; Nikolai & Mersereau, P.A.

(57) ABSTRACT

A versatile system for seizing, tilting and dumping refuse containers is disclosed that includes a maneuverable, multi-position container grasping device attached to a refuse collection vehicle for handling curbside containers during collection efforts and emptying the containers at a plurality of positions relative to the vehicle charging hopper. A container grabbing mechanism is also disclosed.

1 Claim, 18 Drawing Sheets

U.S. PATENT DOCUMENTS 4,461,608 A 7/1984 Boda
4,496,275 A 1/1985 Harp
4,527,939 A 7/1985 Suarez
4,543,028 A 9/1985 Bell et al.
4,566,840 A 1/1986 Smith
4,575,300 A 3/1986 George
4,597,710 A 7/1986 Kovats
4,613,271 A 9/1986 Naab
4,669,940 A 6/1987 Englehardt et al.
4,690,603 A 9/1987 Graner
4,708,570 A 11/1987 Smith et al.
4,726,726 A 2/1988 Dossena et al.
4,844,682 A 7/1989 Edelhoff
4,872,801 A 10/1989 Yeazel et al.
4,889,462 A 12/1989 Naab et al.
4,936,732 A 6/1990 Naab et al.
4,943,201 A 7/1990 Billon
4,948,324 A 8/1990 Niederer
4,983,092 A 1/1991 Richards
4,989,917 A 2/1991 Schmidt, Jr.
5,007,786 A 4/1991 Bingman
5,018,929 A 5/1991 Carson
5,020,844 A 6/1991 Pickrell
5,026,104 A 6/1991 Pickrell
5,026,241 A 6/1991 Wyman
5,035,563 A 7/1991 Mezey
5,044,863 A 9/1991 LaBass et al.
5,049,026 A 9/1991 Bingman et al.
5,071,303 A 12/1991 Carson
5,071,307 A 12/1991 Carson
5,078,560 A 1/1992 Patrick et al.
5,092,731 A 3/1992 Jones et al.
5,098,250 A 3/1992 Carson
5,114,297 A 5/1992 Kirchhoff
5,149,243 A 9/1992 Naab et al.
5,163,805 A 11/1992 Mezey
5,205,698 A 4/1993 Mezey
5,209,537 A 5/1993 Smith et al.
5,222,853 A 6/1993 Carson
5,256,027 A 10/1993 Guest
5,303,841 A 4/1994 Mezey
5,316,430 A * 5/1994 Horning et al. ..... 414/409
5,330,308 A 7/1994 Armando
5,360,310 A 11/1994 Jones et al.
5,391,039 A 2/1995 Holtom
5,398,983 A 3/1995 Ahrens
5,419,671 A 5/1995 Smith et al.
5,474,413 A 12/1995 Georg
5,525,022 A * 6/1996 Huntoon ..... 414/408
5,547,332 A 8/1996 Smith et al.

* cited by examiner

LINEARLY ADJUSTABLE CONTAINER HOLDING AND LIFTING DEVICE

BACKGROUND OF THE INVENTION

I. Field of the Invention

This invention relates generally to material handling equipment and, more particularly, to a maneuverable, multi-position container grasping device attached to a refuse collection vehicle for handling curbside containers during collection efforts and emptying the containers at a plurality of positions relative to the vehicle charging hopper.

II. Related Art

As the world of materials handling becomes more mechanized the desire to move objects with minimal human intervention increases. This has become especially increasingly so with respect to the collection of refuse, particularly curbside collection which has been traditionally characterized by labor intensive manual loading. At a curbside there exists a need not only for devices to tip refuse containers into material receiving hoppers but also for a delivery system that can grasp containers from a range of locations relative to the collection vehicle.

Mechanized material handling devices of the class of interest to the present invention usually have a grasping device attached to a large arm or other means for lifting, moving and tipping a container or object of interest. The grasping device often has a pair of spaced and opposed mechanical arms which function to grasp and release a container by closing down and opening up as operated by one or more actuating devices, such as hydraulic cylinders. In situations where only one actuating device is used, a linkage mechanism is required to achieve dual arm movement.

Grasping devices including a single actuator and a pair of arcuate arms are described in U.S. Pat. No. 4,461,608, to Boda; U.S. Pat. No. 4,708,570, to Smith et al; and U.S. Pat. No. 5,026,104, to Pickrell. Each of the devices described in these patents includes a relatively complex linkage mechanism.

Grasping devices including multiple actuators and two single member arcuate arms have been described in U.S. Reissue Pat. No. 34,292, and U.S. Pat. Nos. 4,227,849 and 4,872,801. In each of these patents, the arms are pivotally attached to a common support member and operated by hydraulic cylinders pivotally attached to the same support member.

A grasping device including multiple actuators and arms having multiple members is described in U.S. Pat. No. 4,669,940, issued to Englehardt et al. In this patent, a pair of straight secondary arms are pivoted to a common support member inside a pair of angled primary arms. The secondary arms roll along the inside of the primary arms to form a hexagon as the primary arms are pushed together by hydraulic cylinders.

U.S. Pat. No. 5,092,731, issued to Jones et al, describes a grasping device including two compound (segmented) arcuate arms linked to an I-beam member operated by actuators.

The devices discussed above are designed to grasp circular objects. A device for lifting and holding containers having a plurality of basic shapes is described in U.S. Pat. No. 4,401,407, to Breckenridge. Breckenridge describes a device having a pair of arms including an inner member pivoted at one end to a frame and an outer member pivoted between its ends to the second end of the inner member. A complex linkage mechanism is attached between the frame and the two members for coordinating movement of the inner and outer members. While the mechanism is functional, a mechanically simpler device for grasping containers having a plurality of shapes is desired.

PCT International Application Publication No. WO 92/01612 describes a device for grasping containers of several shapes. The described device includes oppositely disposed compound articulated arms pivotally attached to a central support member. Each arm includes an inner and an outer member curved to fit around a container and having grip padding for holding the container. In operation, the arms are moved by four actuators. However, the shape of the arms and the grip padding is a compromise, not shaped to fit snugly around the corners of a rectangular object. The corners of a rectangular object fall between the grip padding or are contacted at an angle which limits the ability of the device to manipulate rectangular objects.

A grabber device of the class usable in the combination of the present invention is further illustrated and described in U.S. patent application Ser. No. 08/342,752, filed Nov. 21, 1994, and assigned to the same assignee, entitled "CONTAINER HOLDING AND LIFTING DEVICES". The inventor in that application is Ronald E. Christenson, an inventor in the present application.

A multi-compartment vehicle for unloading and receiving the contents of corresponding multi-compartment collection receptacles is described and shown in U.S. patent application Ser. No. 08/389,097, filed Feb. 15, 1995, entitled "MULTIPLE COMPARTMENT BODY FOR WASTE MATERIALS", by Ronald E. Christenson, the inventor herein, which is assigned to the same assignee as the present invention and the disclosure of which is hereby incorporated by reference for any necessary purposes. That application describes a refuse hauling vehicle including a multi-compartment truck body and a front or side loading, fork-type lift and dump mechanism which lifts and dumps a multi-compartment collection receptacle into a multi-compartment receiving hopper of the truck body.

Other containers of the multi-compartment class are found in U.S. Pat. Nos. 5,071,303 and 5,222,853, issued to Carson, which describe a multi-compartment collection receptacle having a plurality of dedicated compartments with corresponding locking lids. During the dumping operation, a collection receptacle compartment is positioned above a corresponding dedicated compartment in a multi-compartment vehicle and the lid is opened to release the refuse contained therein into the vehicle. A collection receptacle lifting mechanism is mounted on the vehicle body on a rail in a manner that allows it to slide along the length thereof to index or position the collection receptacle as required for unloading.

U.S. Pat. Nos. 5,035,563; 5,163,805; 5,205,698; and 5,303,841, issued to Mezey, illustrate side loading or front loading, multi-compartment refuse vehicles used in conjunction with corresponding multi-compartment collection receptacles or single compartment containers.

Heretofore, however, container lifting and emptying devices have not been able to selectively position a container above a plurality of compartments in a collection receptacle. Thus, U.S. Pat. No. 4,401,407, issued to Breckenridge, and U.S. Pat. No. 5,026,104, issued to Pickrell, describe and show grasping devices connected to extensible boom systems which may be lifted to raise an engaged container above one position along the length of a refuse vehicle. U.S. Pat. No. 5,330,308, issued to Armando et al., describes an automatic container lifting and emptying apparatus including an extensible boom which can pivot vertically to raise an engaged container above the refuse vehicle and horizontally to pivot the container in a partial circle as it is positioned above the truck body. However, these systems have limited versatility and cannot situate the container above more than one position along the length of the truck body, even though the Armando et al. device is provided with an attached grasping device which can pivot in a circular motion at the end of the extensible boom along an axis transverse to the direction of travel of the telescoping boom.

An extensible boom system that carries a grabber device of the articulated opposed digit type with some versatility is illustrated in U.S. patent application Ser. No. 08/480,902, filed Jun. 8, 1995, to Ronald E. Christenson, an inventor herein, and assigned to the same assignee as the present application. That disclosure is also hereby incorporated by reference herein for any necessary purpose.

The separation of materials at the point of collection is becoming, and in the future will become an even more important consideration in the disposal of refuse. Consequently, a collection apparatus including a container lifting and emptying apparatus which can be positionally adjusted along the side of a vehicle to approach receptacles at various locations relative to the vehicle and dump the containers selectively into any one of a plurality of compartments in an attached collection receptacle or vehicle charging hopper.

Objects

It is accordingly a principal object of the invention to provide an improved material collection system.

Another object of the invention is to provide a collection system wherein either a collection receptacle container may be approached in a variety of locations, automatically lifted and emptied.

Yet another object of the invention is to provide a collection system wherein the integrity of loads of segregated material is maintained.

Still another object of the invention is to provide a collection apparatus which includes container lifting and emptying apparatus for automatically unloading a container into the collection receptacle which is positionally adjustable in two directions relative to the receptacle.

Still yet another object of the invention is to provide a container lifting and emptying apparatus for unloading a container into a selected one of a plurality of receptacle compartments.

A further object of the invention is to provide an indexing container lifting and emptying apparatus with the ability to situate an engaged container above a plurality of positions along the length of a collection receptacle.

Other objects, features and advantages of the present invention will become apparent to those skilled in the art through familiarity with the summary of the invention, detailed description, claims, and drawings herein.

SUMMARY OF THE INVENTION

By means of the present invention, there is provided a versatile, extendable seize and release, and lift and dump mechanism or system in which a grabber mechanism is provided with selected maneuverability to address and fetch curbside containers within range of a refuse truck and that is further indexable to empty the containers at several locations relative to a receiving hopper. In the detailed embodiments, this is accomplished by employing a laterally extensible telescoping boom and lift and dump arm system which, in turn, carries a container grabbing mechanism. The container grabbing mechanism is carried on and adjustable along a support arm attached at an angle which extends to the lift and dump arm so that it extends substantially horizontally alongside the charging hopper. The lift and dump arm, in turn, is carried on the telescoping boom member and retracts laterally.

The lift and dump arm is vertically pivotable with respect to the boom with the grabbing mechanism situated at any position along the horizontal support arm as it extends along parallel to the charging hopper. This allows dumping of the container at any location along the charging hopper. The extensible boom is also capable of limited tilting to increase the container tipping angle with the lift and dump arm fully raised. A fluid operated cylinder is used to position a rider member carrying the grabber along the support arm. Likewise, linear operators or actuators are used to extend and retract the extensible boom and to tilt the boom in the retracted position and to pivot the lift and dump arm of the system.

Because the grabber can be situated anywhere along the support arm, it can seize a container in a variety of locations along the charging hopper and thereafter deposit the contents of that container at any and possibly the same location with respect to a longitudinally split multi-compartment charging hopper. The support arm for the grabber remains substantially horizontally disposed throughout the operation so that the container tilts only toward the charging hopper.

The grasping function of the present invention is performed by a gripping or grabbing device having a pair of spaced, opposed arms pivotally connected to a central support member. The arms are generally shaped to entrap containers of a plurality of different geometric cross-sectional shapes, including curved, rectangular, hexagonal and others. The arms are preferably multi-segmental and pivot between an open or retracted position and a closed or grasping position by operating actuators. The inner and outer segments have shaped inner surfaces to accommodate a plurality of different geometric shapes. Each outer segment may be provided with a composite construction which includes a tip roller which contacts and urges a container of interest toward the common support member as the arms close to retain the container in place. The opposed arms are operated by coordinated pairs of linear actuators (preferably double acting hydraulic cylinders).

While the detailed embodiments are devoted to refuse trucks, the loading device of the present invention may be mounted on other vehicles including dump trucks or may even be employed as a stationary loader.

DETAILED DESCRIPTION

The container handling system of the present invention is illustrated in the several figures with respect to providing a versatile container addressing, seizing and lift and dump mechanism as applicable to loading a multi-compartment charging hopper of a refuse vehicle. The system is particularly useful in side loaded refuse vehicles of the multi-compartment variety, particularly those in which the charging hopper assumes a multi-compartment configuration which is characterized by a longitudinally split entry or split access. Such a charging hopper is designed to receive material in two or more juxtaposed consecutive charging hopper compartments, each associated with a connected, dedicated storage compartment in the truck body and provided with a compaction device to sweep received material into the associated storage compartment. Such multi-compartment systems are illustrated and described in greater detail, for example, in the above-referenced copending application Ser. No. 08/387,087.

The present invention contemplates a container handling system of a type designed to reach out and approach containers, for example, at curbside spaced from the path of the refuse vehicle. The system is further designed to address various shaped containers of a size generally wheeled or carried to curbside by individual homeowners or tenants. The system is one capable not only of reaching directly to the side of the vehicle to approach containers but also is capable of longitudinal adjustment so that precise vehicle/container lateral alignment is not critical to successful operation. The longitudinal adjustment further enables the system to empty a seized container into any designated one of a plurality of longitudinally consecutive charging hopper accesses.

Figure 1:
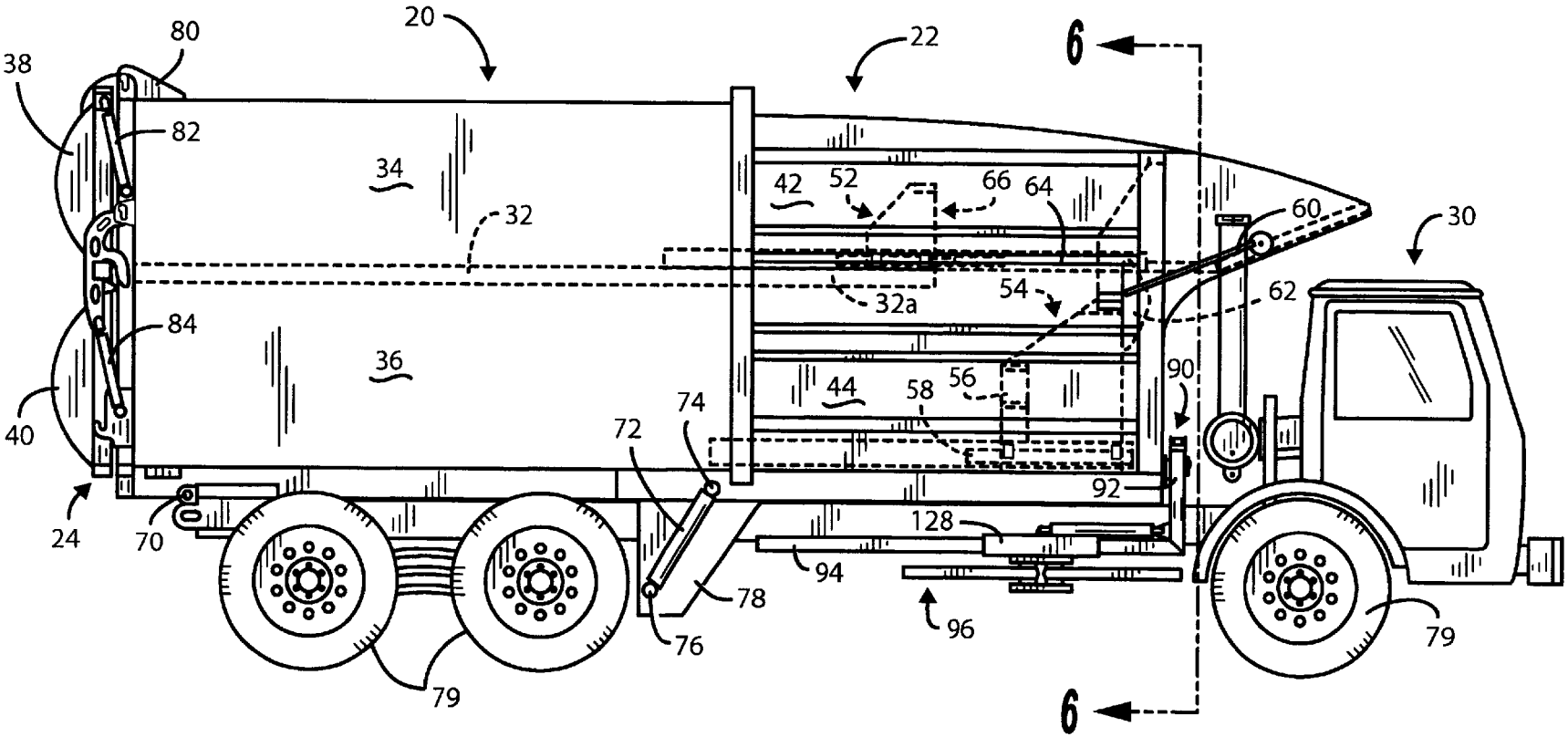
FIG. 1 is a side elevational view of a two-compartment refuse collection vehicle equipped with a container handling system according to the invention.
Figure 2:
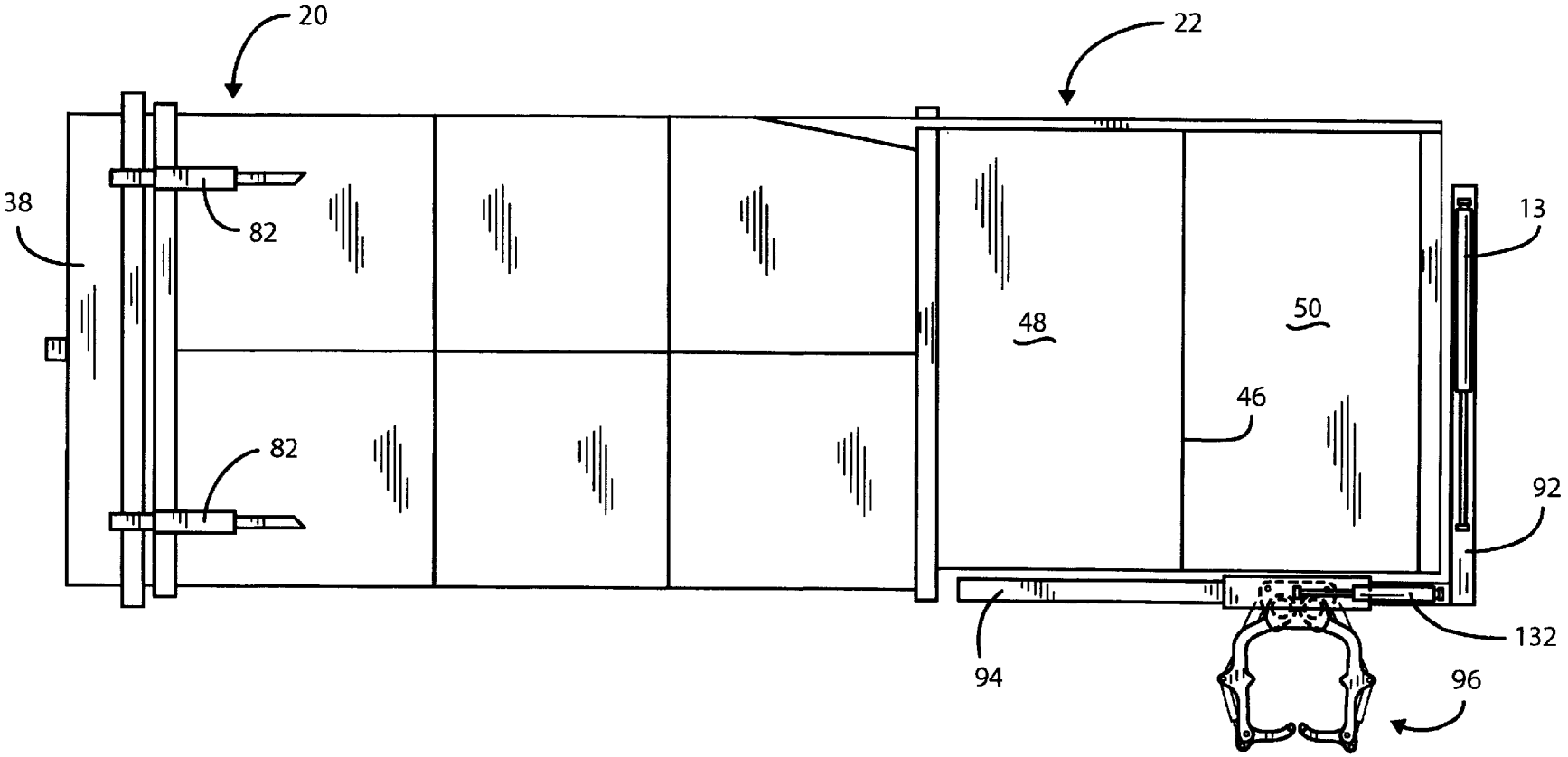
FIG. 2 is a top view of the refuse collection portion of the vehicle of FIG. 1 showing the grabbing device of the container handling system in the forward location and in the closed or container-engaging position.
Figure 3:
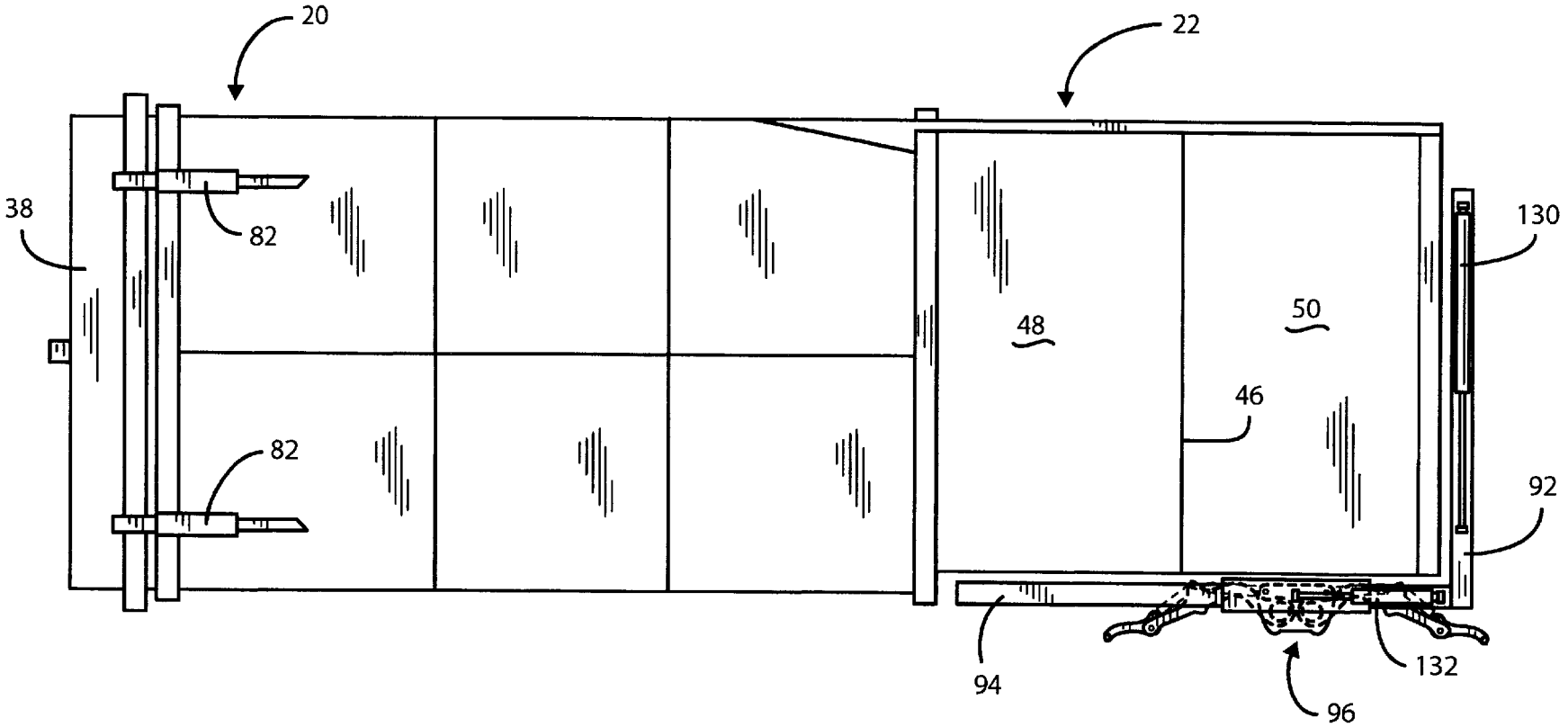
FIG. 3 is similar to FIG. 2 depicting the container gripping device in the fully open, stowed position.

An overview of one container handling system can be had with reference to a side loading refuse truck in FIGS. 1–3 of the drawings. The refuse vehicle includes a storage body or truck body, generally at 20 and connected to receive material from a separate or integral charging hopper generally at 22 which, in turn, are carried on a common sub-frame 24. The sub-frame 24, in turn, is carried by the main truck chassis or frame including heavy chassis frame members 26 and 28 (FIG. 6*a*) which also carry a cab 30.

Storage body 20 includes an intermediate horizontal panel 32 which divides the storage body into two (upper and lower) storage compartments 34 and 36, each served by a mechanized tailgate or rear door, respectively 38 and 40. The charging hopper 22 is subdivided into two (upper and lower or aft and fore) material receiving compartments 42 and 44 by the panel 32, or an extension thereof at 32*a* in combination with a transverse vertical separator wall or panel 46 which meet at a substantially right angle, the panel 46 splitting the open top receiving area of the charging hopper into front and rear receiving openings 48 and 50 which respectively feed charging compartments 42 and 44 therebeneath.

Each of the charging hopper compartments 42, 44 is provided with a packing system as at 52 and 54. The lower system 54 includes a reciprocally operating vertical packing plate 56 operated by a pair of double acting hydraulic cylinders, one of which is shown at 58, and a protective follower cover is shown at 60. The upper packing system may have a separate individually operated hydraulic cylinder mechanism or operate via a system of compliance linkage members as shown in FIG. 1, that includes a vertical link member 62 and horizontal connecting or compliance rod 64 which operate packer 66 in conjunction with the operation of the lower packing system 54. Such a system is shown in greater detail in commonly assigned copending application Ser. No. 08/389,097 which is incorporated by reference for any purpose.

The sub-frame 24 is carried by the truck chassis in a manner that allows it to be tipped with the body attached for refuse discharge. In this manner, it is mounted to pivot about a rear fulcrum 70, the front end being raised by a pair of hydraulic cylinders, one of which is depicted at 72, connected between the sub-frame as at 74 and the chassis as at 76 mounted from heavy flange 78. The entire structure is conventionally carried on wheels 79.

The tailgates or rear doors 38 and 40 may be configured to lift and swing open separately or be constructed as part of a single tailgate assembly. A system for separate operation is illustrated by the figures, including top hinges 80 and cylinders as at 82 to operate the upper tailgate and cylinders as at 84 to operate the lower tailgate. Further details of the construction and operation of the tailgates as well as those of the lifting sub-frame are known and need not be repeated here as they form no part of the present invention.

The present invention particularly focuses on automating the vehicle loading system, particularly in seeking out curbside containers and emptying them into selected diverse refuse compartments of the charging hopper. The loading system includes a laterally extendable boom system, generally at 90, which carries an angle-shaped lift and tilt arm 92 (FIG. 2) which in turn is connected to longitudinally extending support member 94 which carries a container grabber or gripper arrangement, generally 96, designed to seize a container of interest for emptying, and which is adjustable along the member 94. The longitudinally extending aspect 94 extends along the side of the charging hopper and carries the grabber device 96 on a mechanized rider member 128 which is slidably adjustable along the member 94.

Figure 6A:
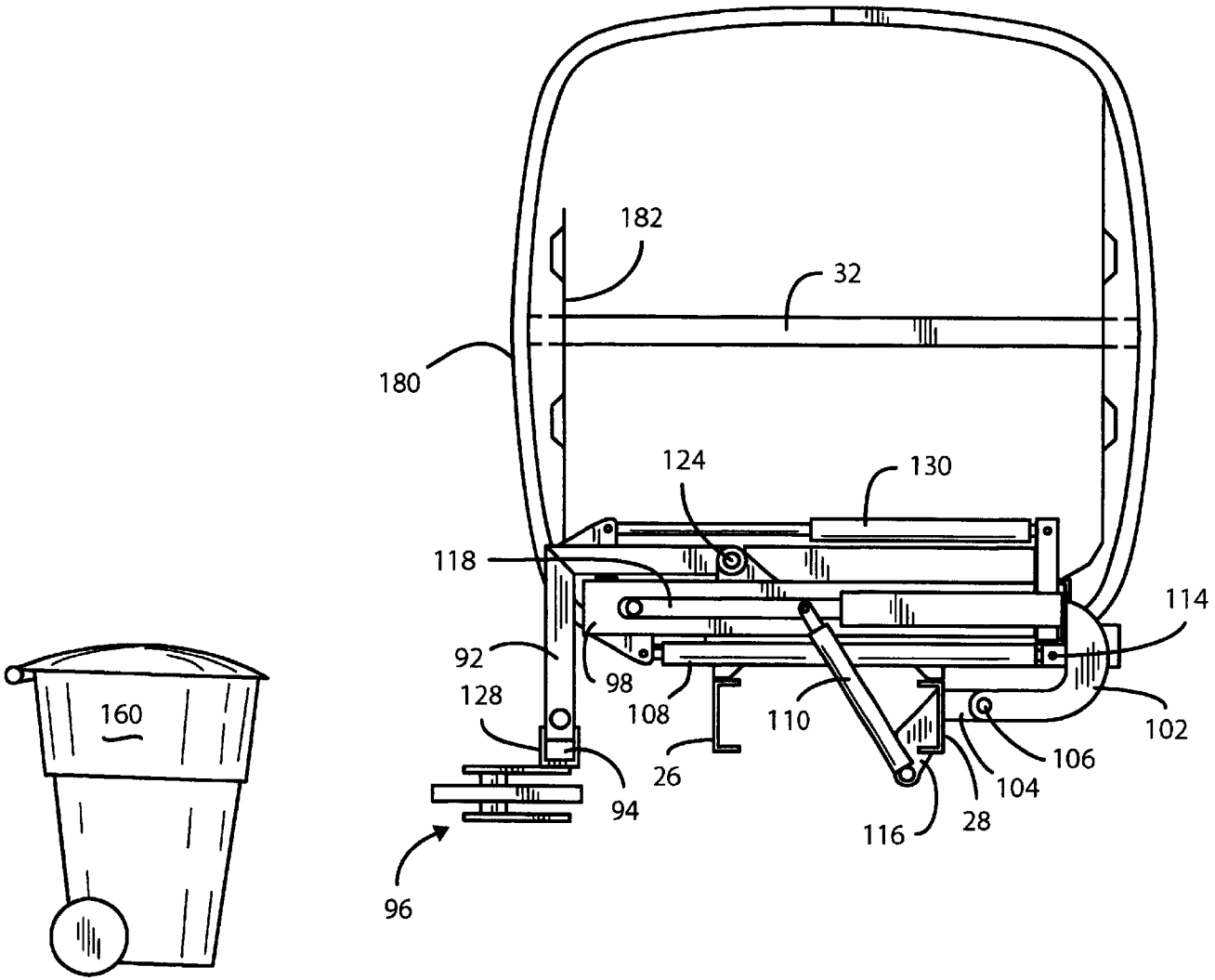
FIGS. 6*a*–6*c* are front elevational views (with cab removed) of a refuse collection vehicle showing one embodiment of the container handling system in the stowed position prior to approaching a spaced refuse container, entered in the seizing or grabbing position and in the elevated dumping position, respectively.
Figure 6B:
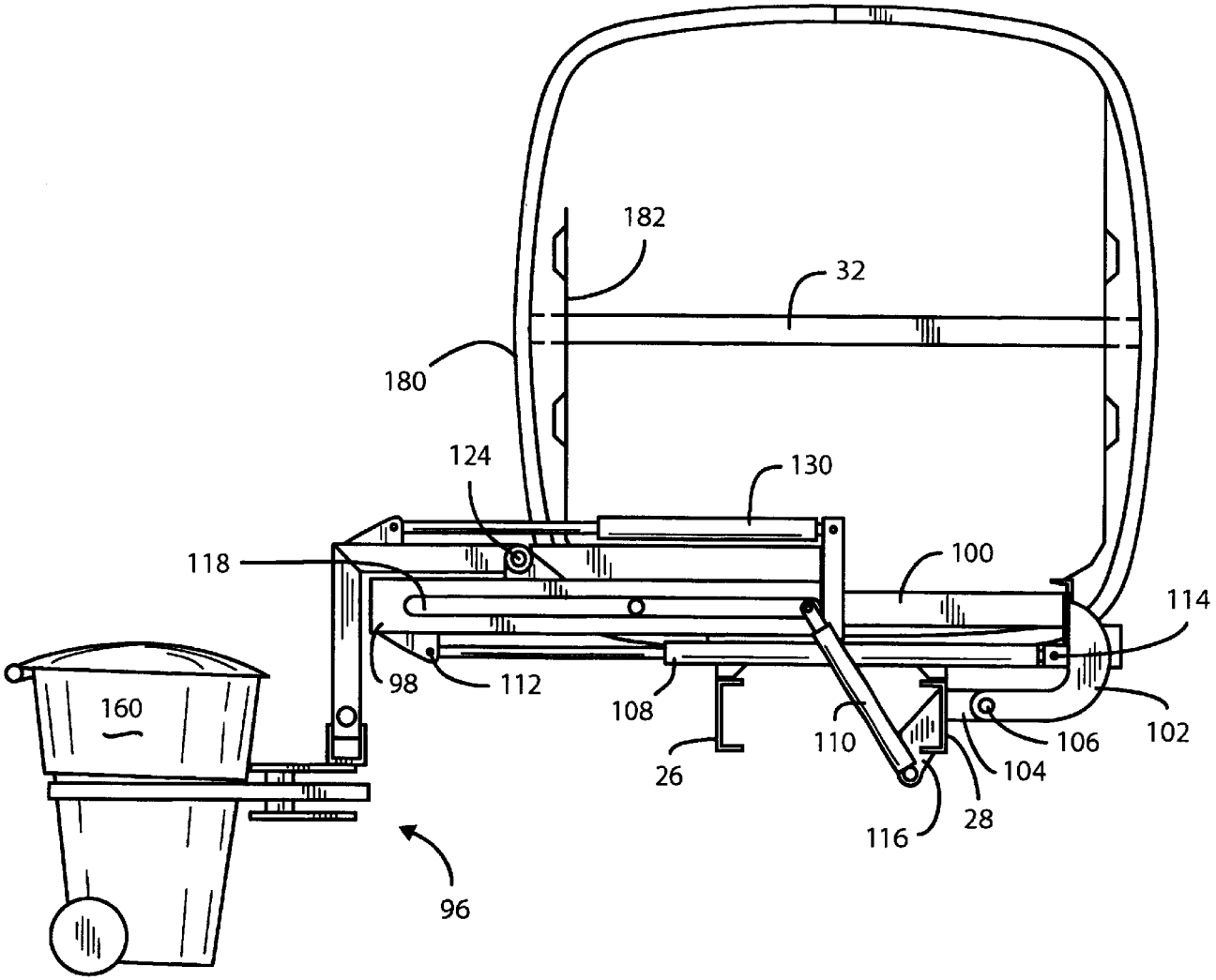
Figure 6C:
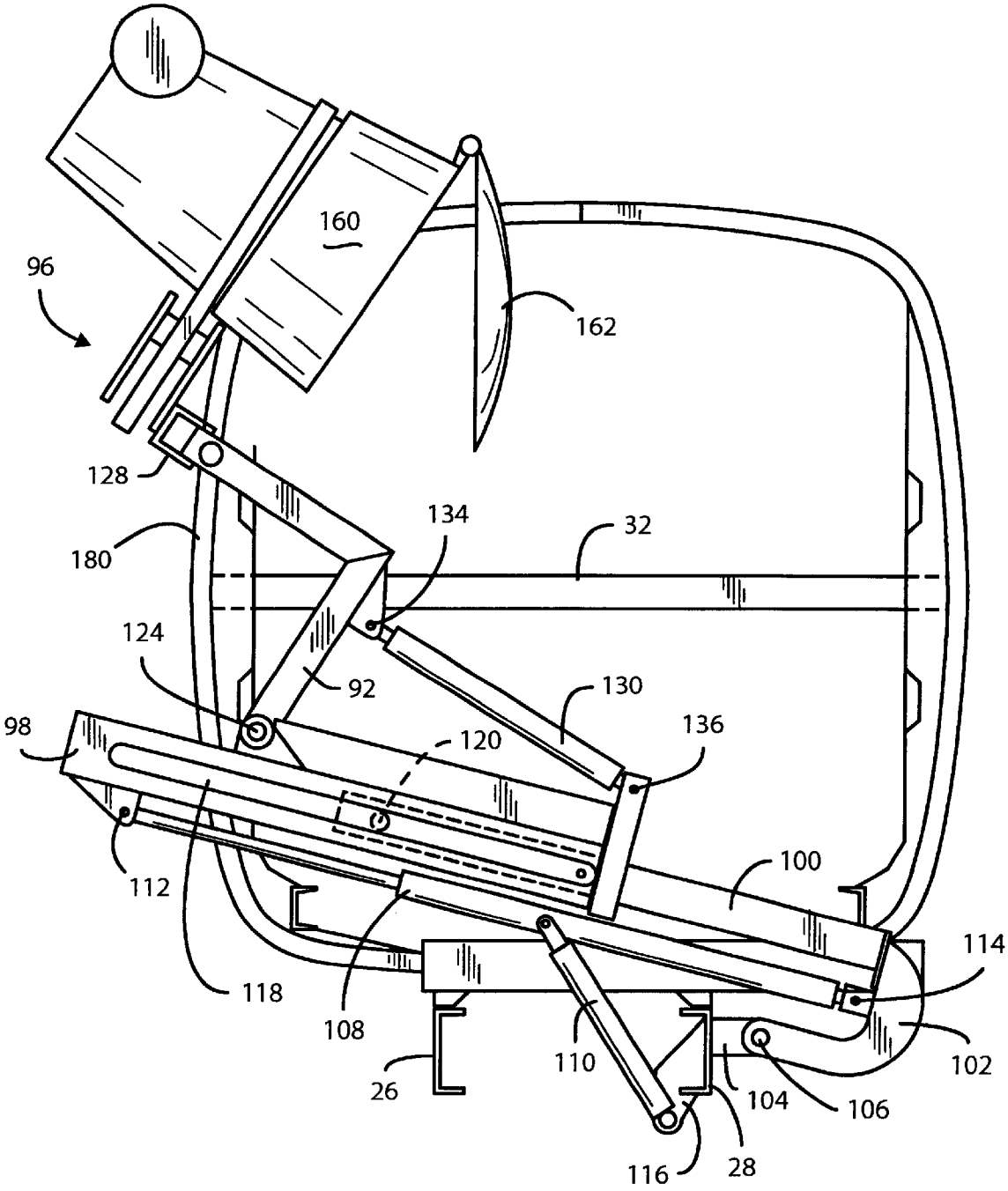

One embodiment of the container handling mechanism is illustrated by the FIGS. 4*a*–4*c*, 5*a*–5*c* and 6*a*–6*c*, which, as will be appreciated, accomplishes rather complex and sophisticated grabbing, lifting and dumping functions using a relatively uncomplicated mechanism. The boom is designed to telescope laterally to extend the lift and tilt arm mechanism so that the grabber can approach and seize containers spaced from the vehicle. The mechanism is further designed to adjust the rider member along the member 94 to further provide a range alongside the vehicle as seen in FIGS. 6*a*–6*c,* the extendable boom main arm structure 98 is slidably mounted on a structural support system including members 100, 102 and 104. The extendable boom 90 is slidably mounted on and carried by the member 100 which is fixed to member 102 which in turn is vertically pivotally attached to mounting flange 104 at 106. Flange 104 is fixed to chassis member 28. The linear extension of the boom arm 98 is controlled by pivotally connected double acting hydraulic cylinder 108 and the angular displacement thereof by a double acting cylinder 110. The cylinder 108 is connected between the boom arm 98 at 112 and the member 102 conventionally at 114. The cylinder 110 is connected between a mounting flange 116 fixed to chassis member 28 and a follower member mounted in a slot 118 in the arm 98. A travel limiting means is provided at 120 at which point the extension of cylinder 110 causes the boom 90 to tilt upward.

The tilt arm system includes an angled arm segment 92 attached at a fixed end to the boom arm 98 by a pivot joint 124 and at a free end to grabber support member 94 that extends parallel to the charging hopper and slidably carries a grabber mounting rider member 128 to which, in turn, the grabber device 96 is fixed. The grabber adjust and lift and dump aspects of the system 90 are operated by a pair of hydraulic cylinders 130 and 132. The cylinder 130 is pivotally connected between the arm 92 and the boom arm 98 at joints 134 and 136 to operate the joint 124 to raise and lower the arm system. Cylinder 132 is connected between the member 94 of the arm system and the grabber mounting rider member 128 to position the member 128 along the member 94 as shown in FIGS. 4*a*–4*c* and FIGS. 5*a*–5*c*.

Figure 4A:
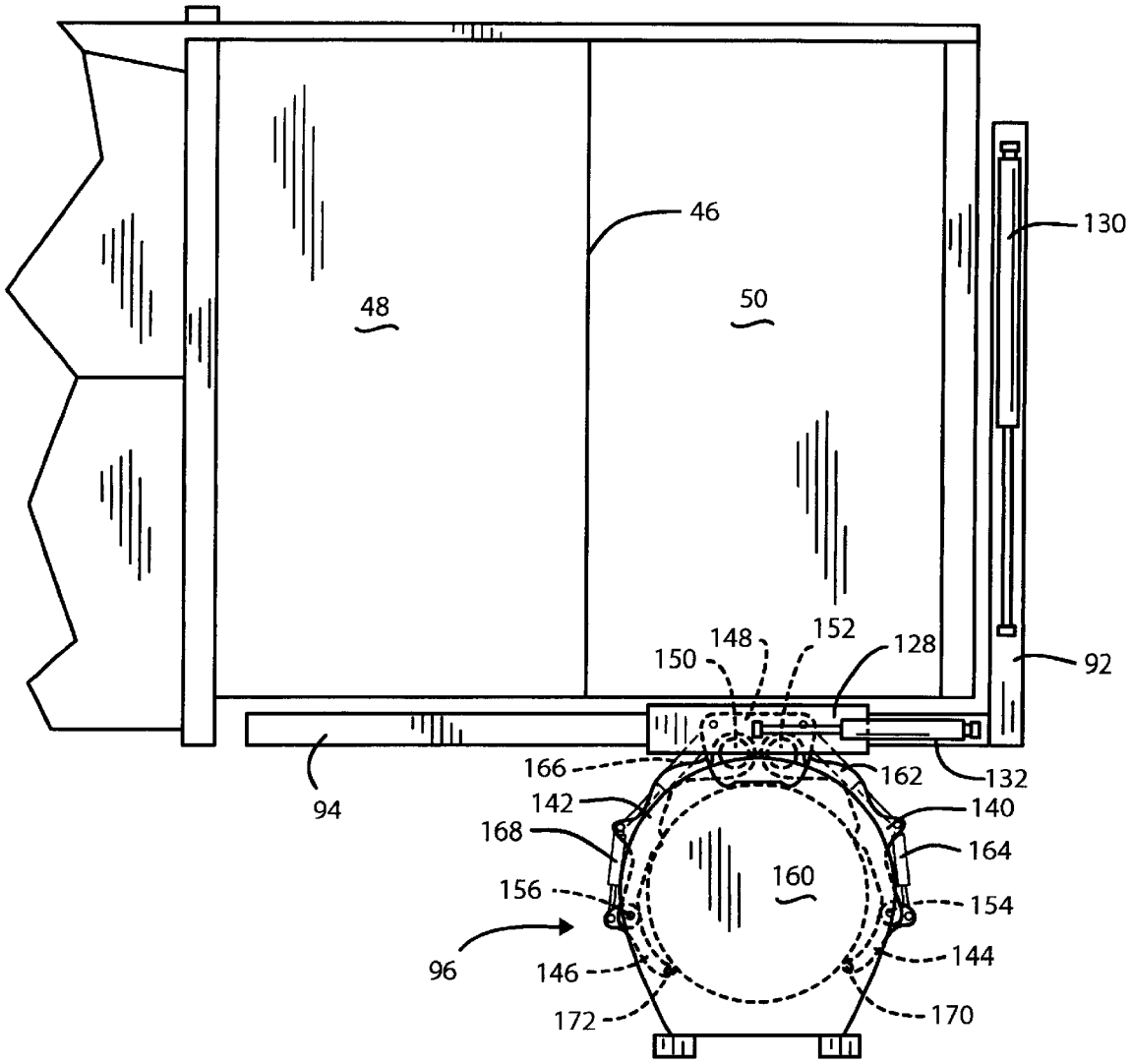
FIGS. 4*a*–4*c* are enlarged partial top views of the vehicle loading section of FIG. 2 depicting the grabber as closed in forward, intermediate and aft loading positions with respect to the truck receiving hopper.
Figure 4B:
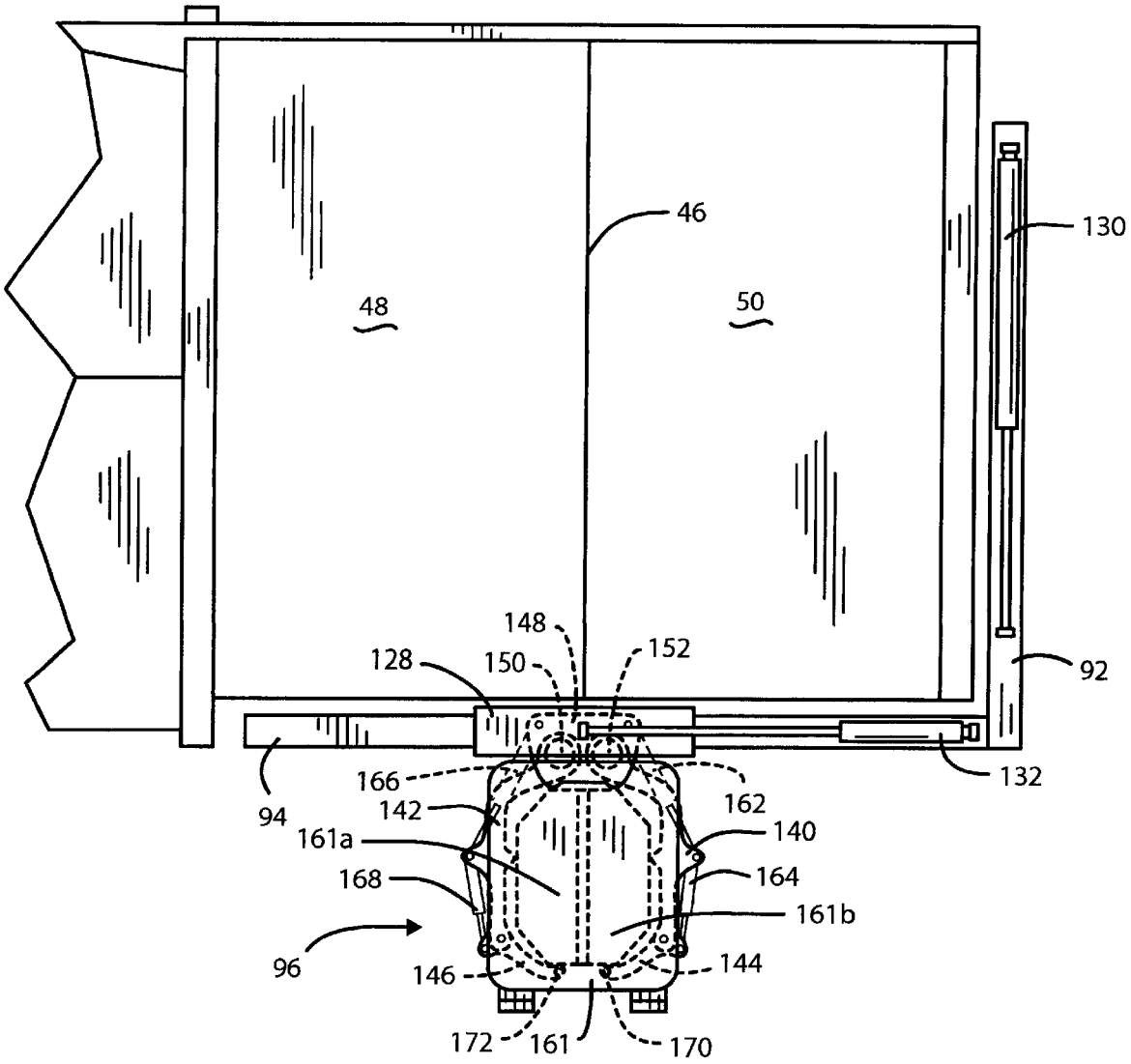
Figure 4C:
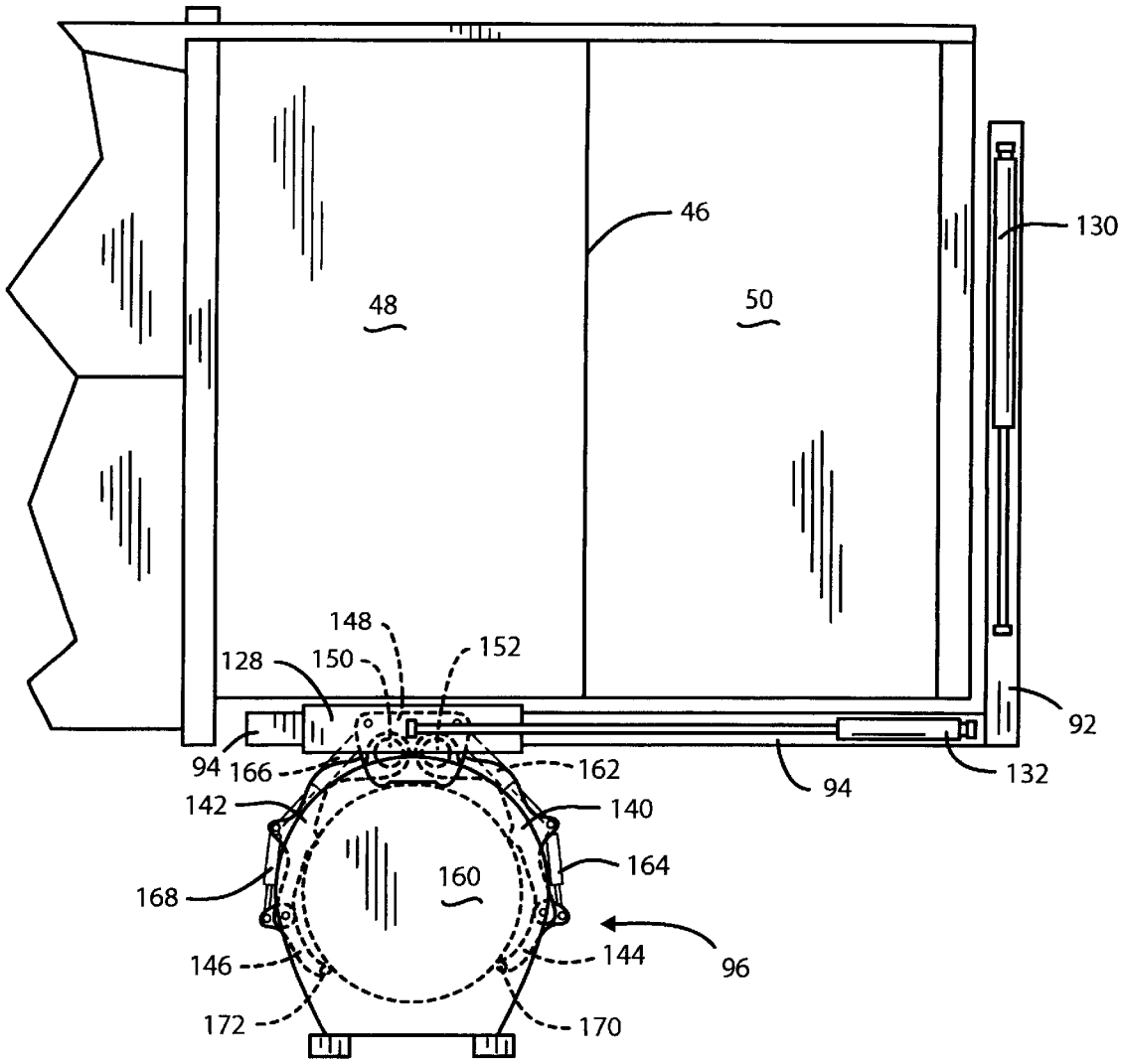
Figure 5A:
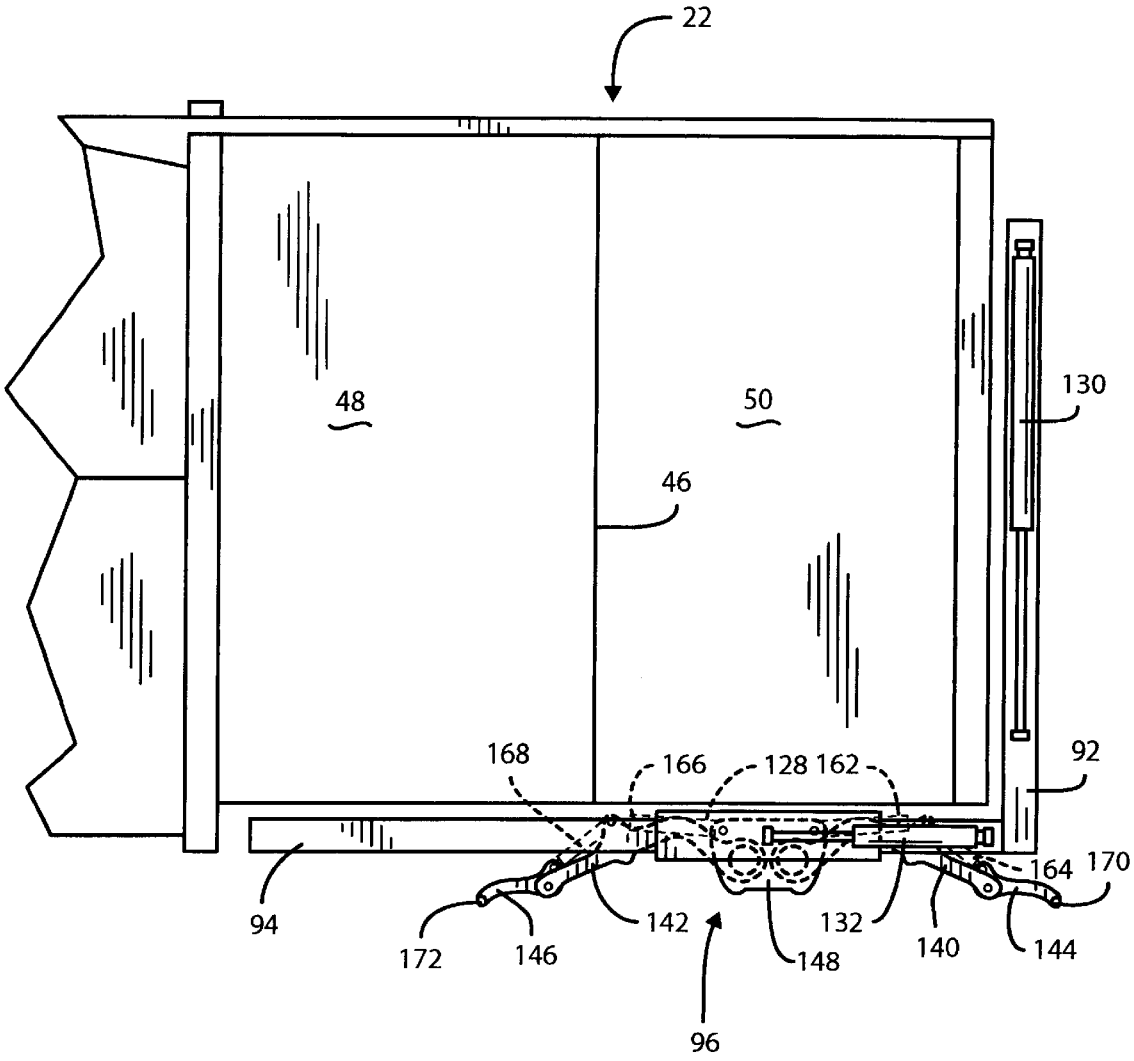
FIGS. 5*a*–5*c* represent enlarged partial top views of the vehicle loading section of FIG. 3 depicting the grabber as open or stowed in forward, intermediate and aft positions.
Figure 5B:
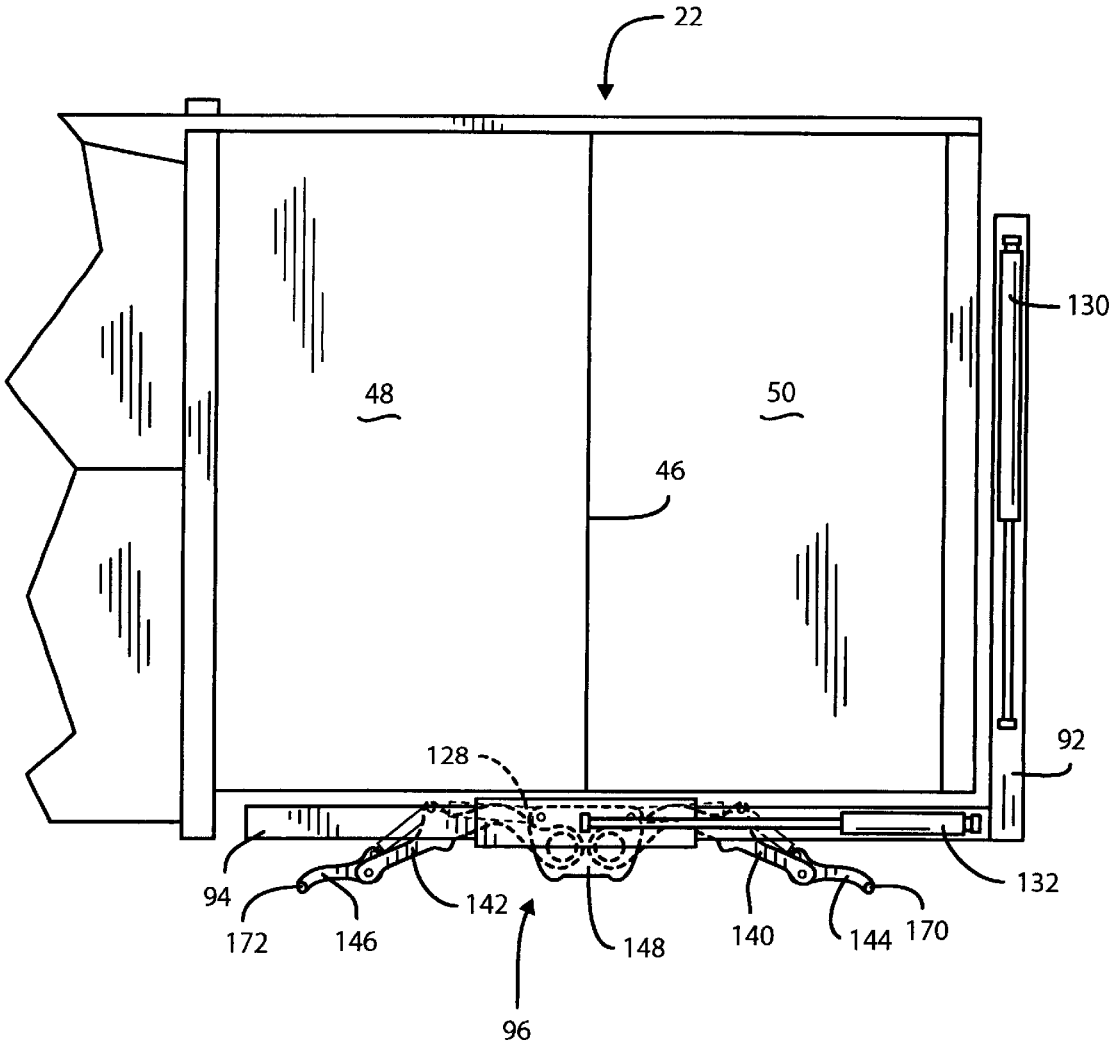
Figure 5C:
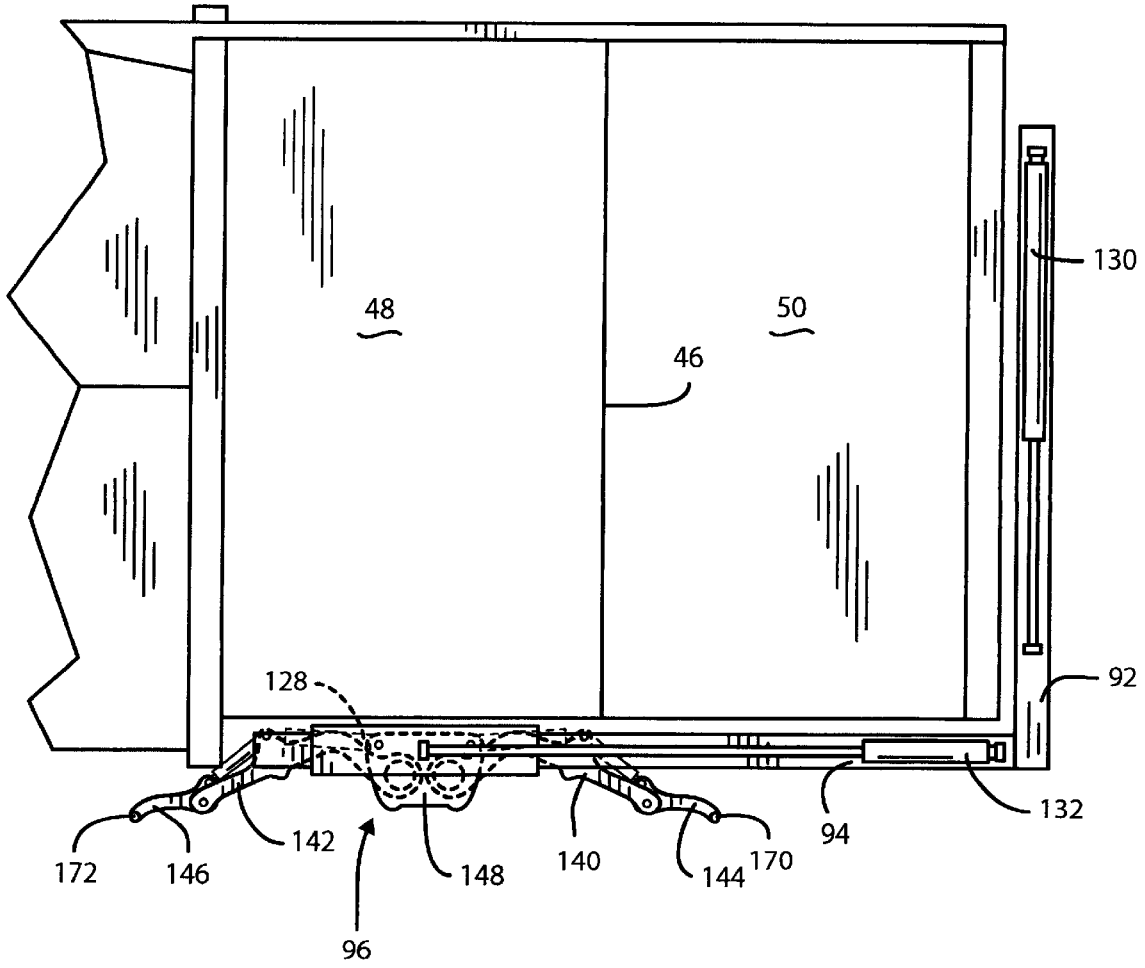

As shown best in FIGS. 4*a*–4*c,* the grabber system 96 can be any of several types of encircling dual arm grabbers including opposed digits, preferably compound jaw elements having inner segments 140 and 142 flanked by outer segments 144 and 146. The inner segments 140 and 142 are pivotally connected to a base element 148 at 150 and 152, and outer segments 144 and 146 likewise are pivotally connected to the respective inner elements at 154 and 156. The jaw elements are operated to close or open to seize or release a rigid container as a round container at 160 or polygen 161 (FIG. 4*b*) by pivotally connected, oppositely disposed pairs of linear actuators, including inner and outer actuators 162 and 164 operating connected pair jaw segments 140 and 144, respectively. Likewise actuators 166 and 168 in a like symmetric manner are connected to operate segments 142 and 146. Roller members 170 and 172, mounted in the jaw segments 144 and 146 guide the outer digit or jaw segments to follow about the periphery of a container of interest to be seized.

The operation of the container handling system is best illustrated by the FIGS. 6*a*–6*c*. The grabber is illustrated as in the fully closed or gripping position in FIGS. 4*a*–4*c* to better depict the construction of the grabber and the arm segment that carries it. A normal pick up sequence, of course, begins with the grabber 96 in the fully opened or stowed position (FIGS. 5*a*–5*c*), the arm 92 lowered and the boom arm 90 fully retracted as depicted in the end view of FIG. 6*a*. It is noteworthy that the system in this position has a relatively narrow profile and protrudes laterally very little beyond the side wall 180 of the storage compartment even though the charging hopper as evidenced by wall 182 is of normal width or minimally recessed.

In the stowed position, the telescoping boom operating cylinders 108 and 110 are fully retracted or collapsed and the arm operating cylinder 130, extended. The cylinder 132 can be in any position as the location of the grabber 96 along the member 94 is not critical during stowage. To approach a container of interest, the cylinder 108 is employed to extend the telescoping boom arm 98 laterally and the cylinder 132 is employed to align the grabber 96 longitudinally with the container of interest along the vehicle as at 160 and 161. In FIG. 6*b,* the actuators 162, 164, 166 and 168 also have been extended to cause the grabber 96 to seize the container 160. In FIG. 6*c,* the telescoping boom has been partially retracted and the cylinder 130 retracted to pivot the arm member 92 into the raised position and the cylinder 110 has been extended to provide the additional tilt for the system to facilitate dumping the container 160.

Just prior to the lift and dump position of the sequence (FIG. 6*c*), the cylinder 132 can be used to further adjust the position of the container alongside the desired opening in the charging hopper 22 so that the contents of the container 160 are discharged into the proper charging hopper compartment. A split container as at 161, having compartments 161*a* and 161*b* designed to empty on either side of the partition 46 can also be emptied as desired. This is because the container handling system of the invention can be used to address any number of sequentially situated charging hopper openings and the cylinder 132 can be programmed to index to any of a number of consecutive positions or to locate between compartments (opposite a dividing panel such as 46) so that a split bucket, as at 161, can be emptied into a plurality of charging hopper compartments. Of course, as has been well documented in previously filed applications such as above-incorporated Ser. No. 08/480,902, the grabber system is quite versatile with respect to its ability to seize containers having a variety of cross-sectional geometries.

Once the material is deposited in the charging hopper compartments, the compaction cycle can be initiated as desired. This loads and compacts the materials received in the storage compartments in a well known manner.

An alternate extendable boom system is depicted in the FIGS. 7*a*–7*c* and 8*a* and 8*c*. As depicted in the broken or fragmentary perspective views of 7*a*–7*c* in which a boom system depicted generally at 200 includes an outer arm 202 which carries protruding extendable inner arm member 204 and is further pivotally mounted at 206 to an arm mounting frame including a support member 208. The boom is extended and retracted by an extension operating cylinder 210 mounted within the stationary outer member 202 of the boom system 200 pivotally at 212 and connected to extend and retract the inner member 204 as at a pin connection 214. A further arm segment 216 is pivotally connected to the inner arm member 204 as by a bearing joint at 218. This segment is operated by a dump cylinder 220, having a rod end connected to an eccentric or bell crank member 222, which is fixed to pivot the arm member 216 with the operation of the cylinder 220. The cylinder 220 is mounted at its fixed end to structural member 224 which is fixed to the telescoping inner member 204. Member 216 is further connected to longitudinally extending member 226 which carries a rider member 228 operable by a further double acting cylinder 230 which moves a grabber mechanism, generally at 232, carried by the rider member 228 along member 226 in the manner of previously-described embodiments. The grabber 232 may be the same as the grabber 96 previously described and is designed to handle round containers as at 234 depicted in the FIGS. 7*a*–7*c* and 8*a*–8*c* or other geometric configurations as desired.

A further cylinder 236 connected between the structural member 238 attached to the vehicle chasis member 26 and stationary outer boom member 202 at 240 is utilized to pivotally raise and lower the outer boom member 202 relative to the frame member as at 208. This cylinder functions with the cylinder 220 to accomplish the lift and dump aspects of the employing cycle.

Figure 7A:
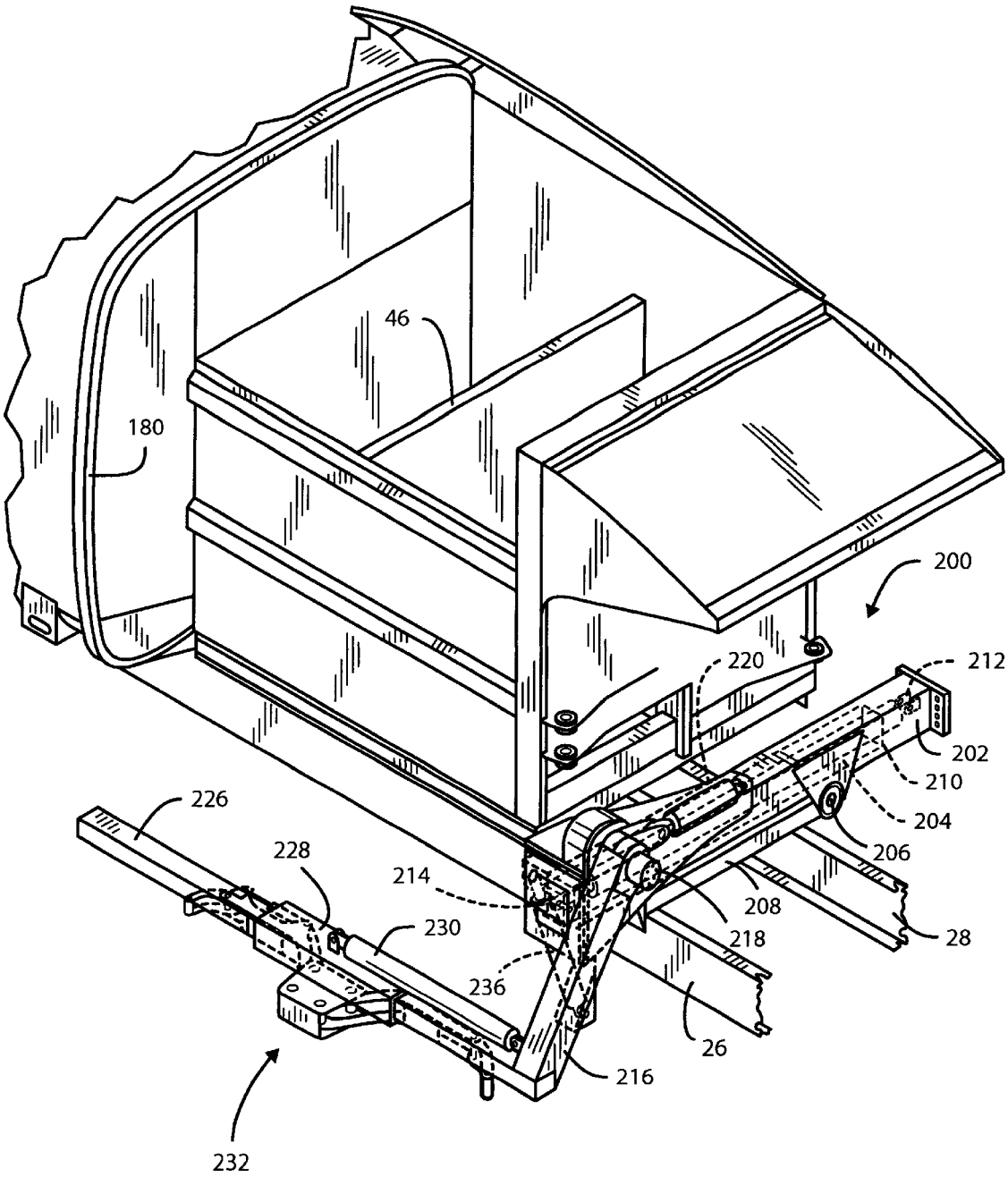
FIGS. 7*a*–7*c* depict partial perspective views of the vehicle loading section with parts removed depicting an alternate embodiment of the container handling boom system in which the grabber device is shown in the fully open and stowed position, in the fully forward, intermediate and aft locations, respectively.
Figure 7B:
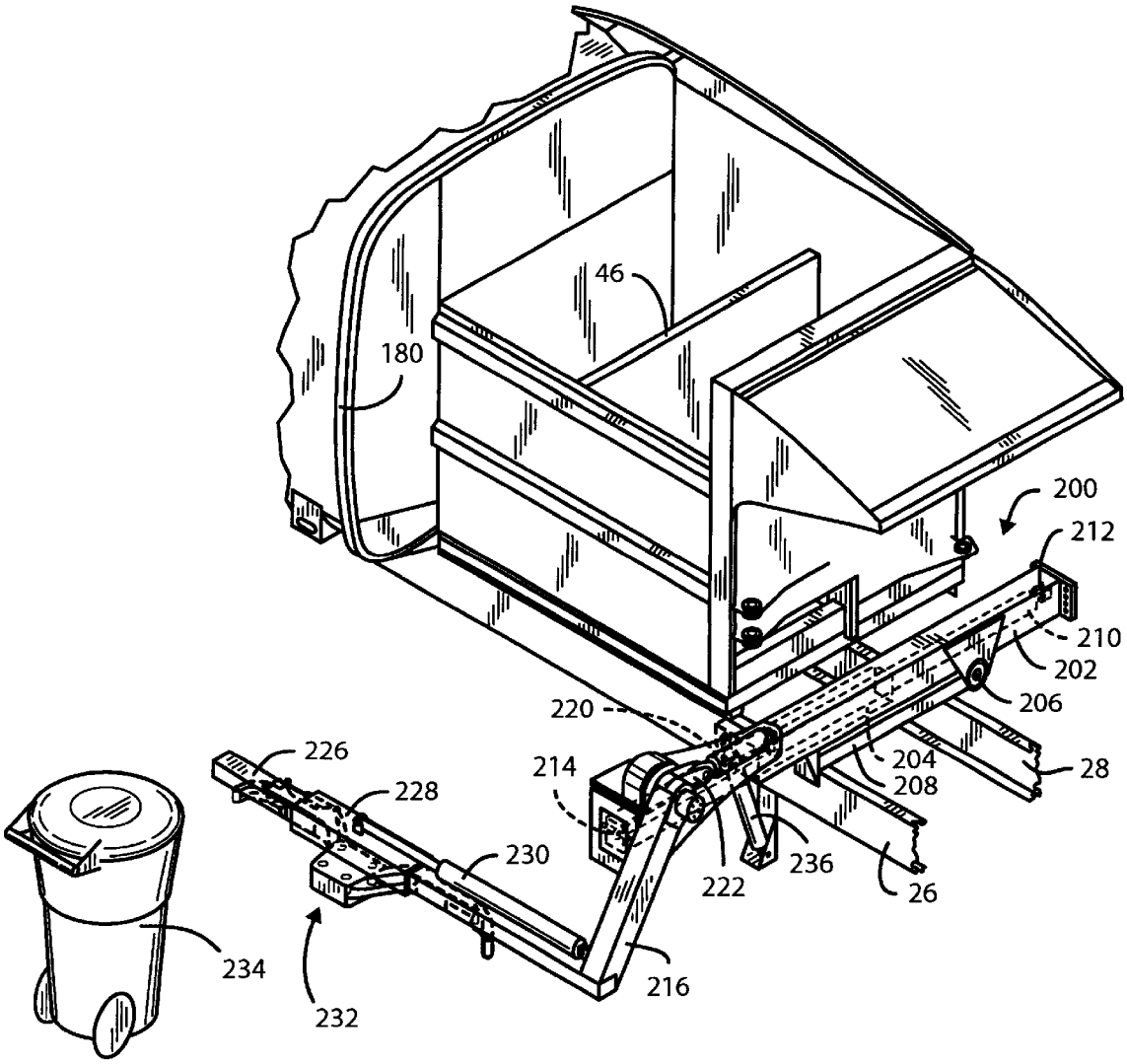
Figure 7C:
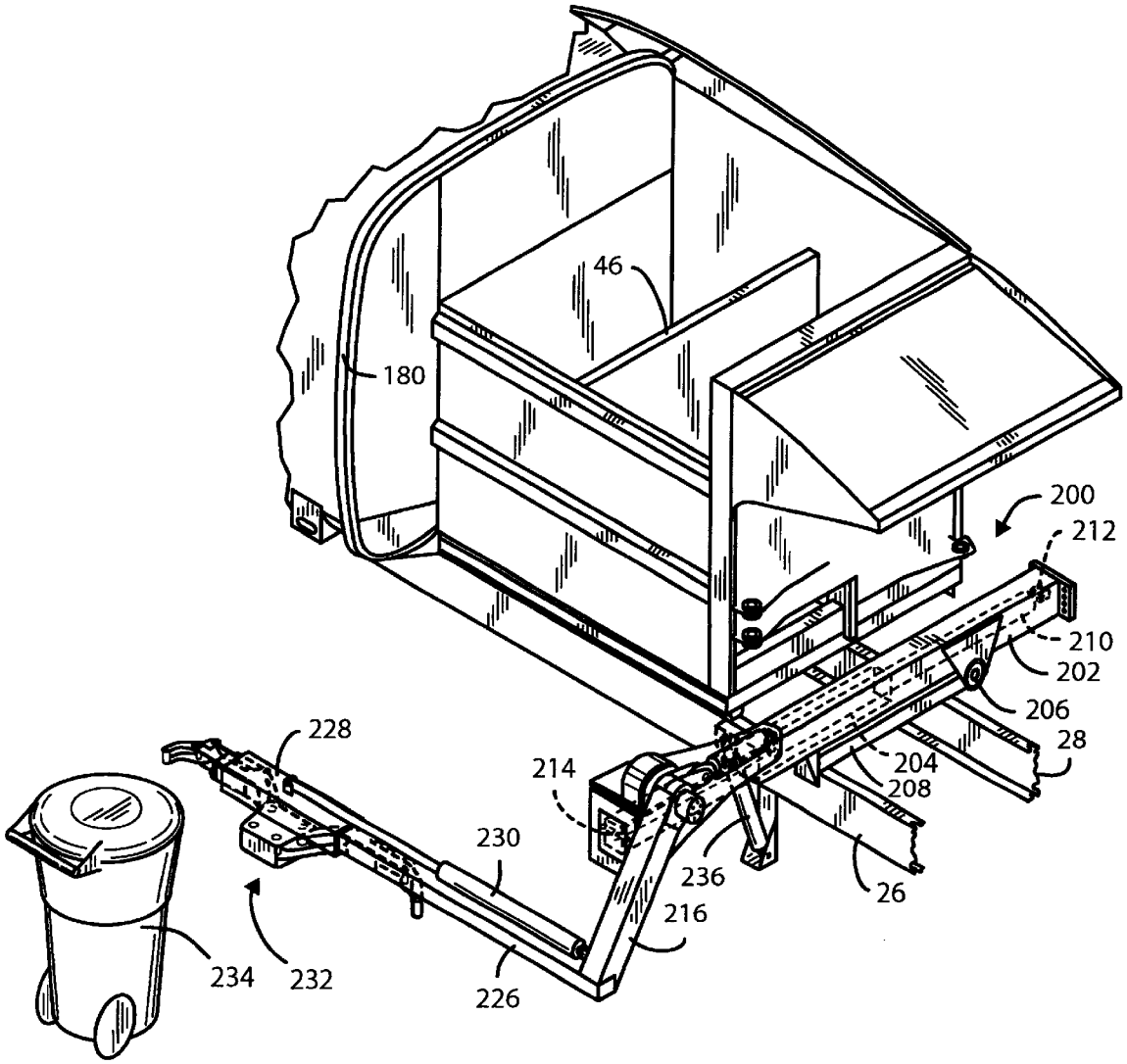
Figure 8A:
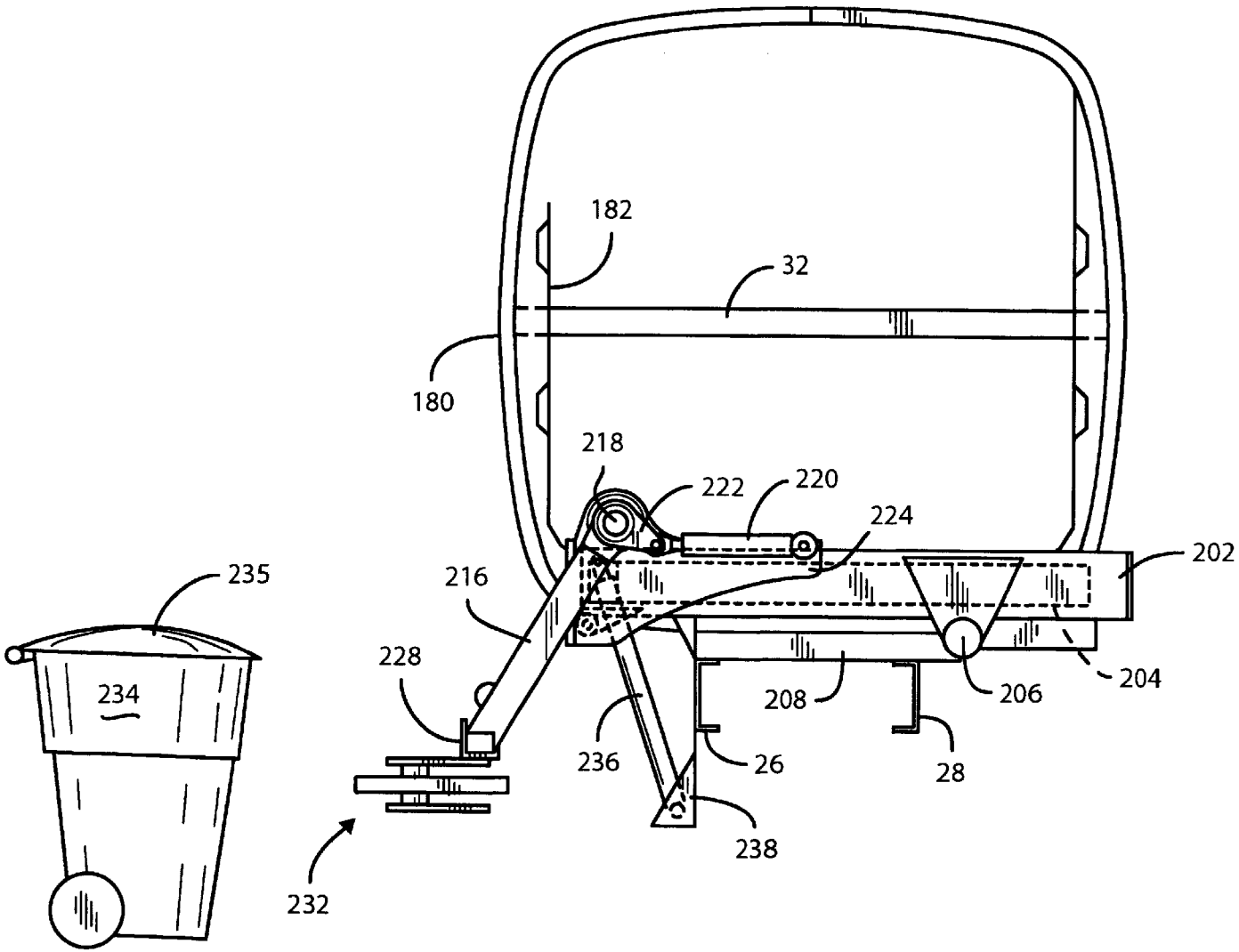
FIGS. 8*a*–8*c* are views similar to FIGS. 6*a*–6*c* illustrating the alternate embodiment of FIGS. 7*a*–7*c* depicting the container handling system in the stowed position prior to approaching a spaced refuse container of interest, with boom extended in the grabbing position and in the elevated dumping position, respectively.
Figure 8B:
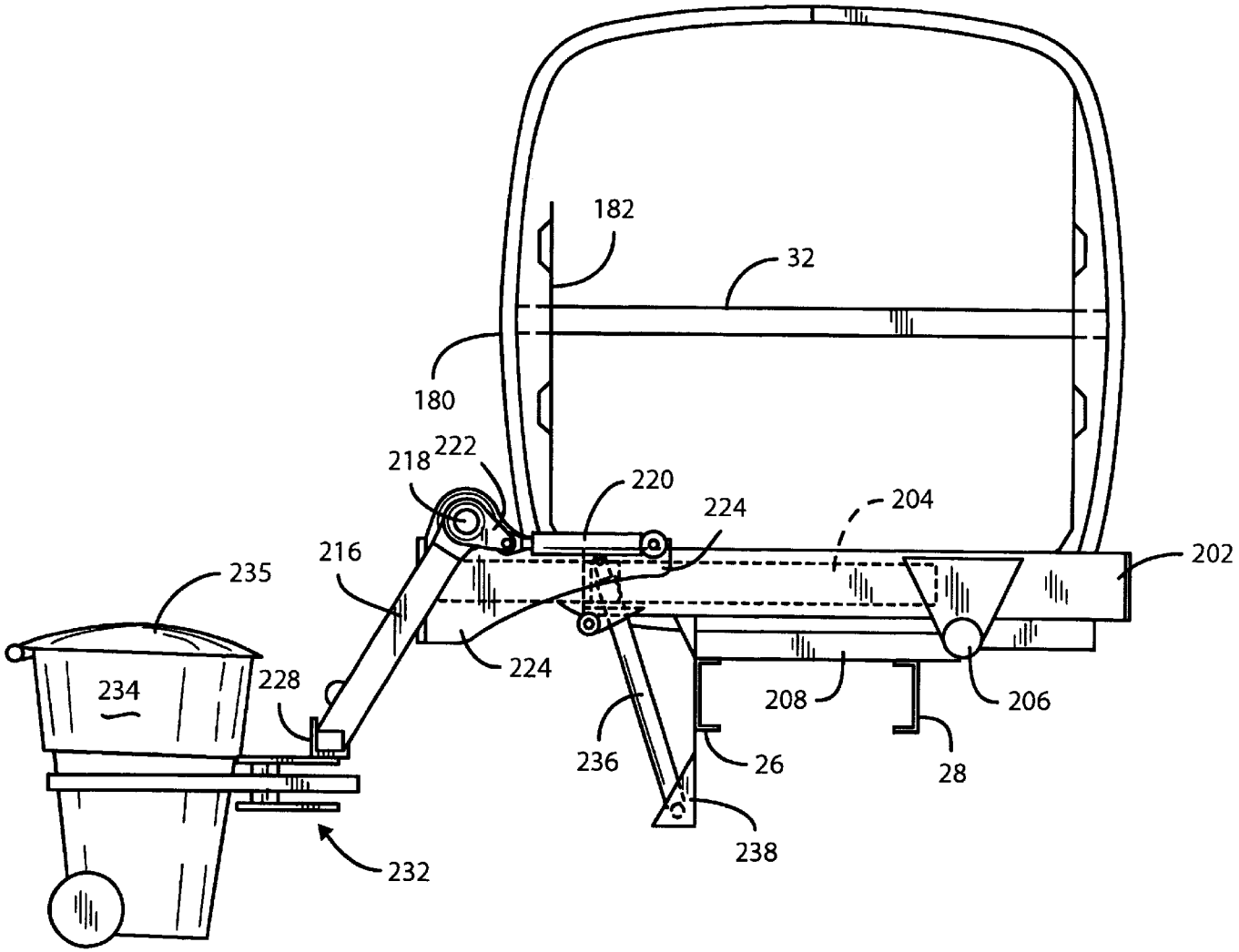
Figure 8C:
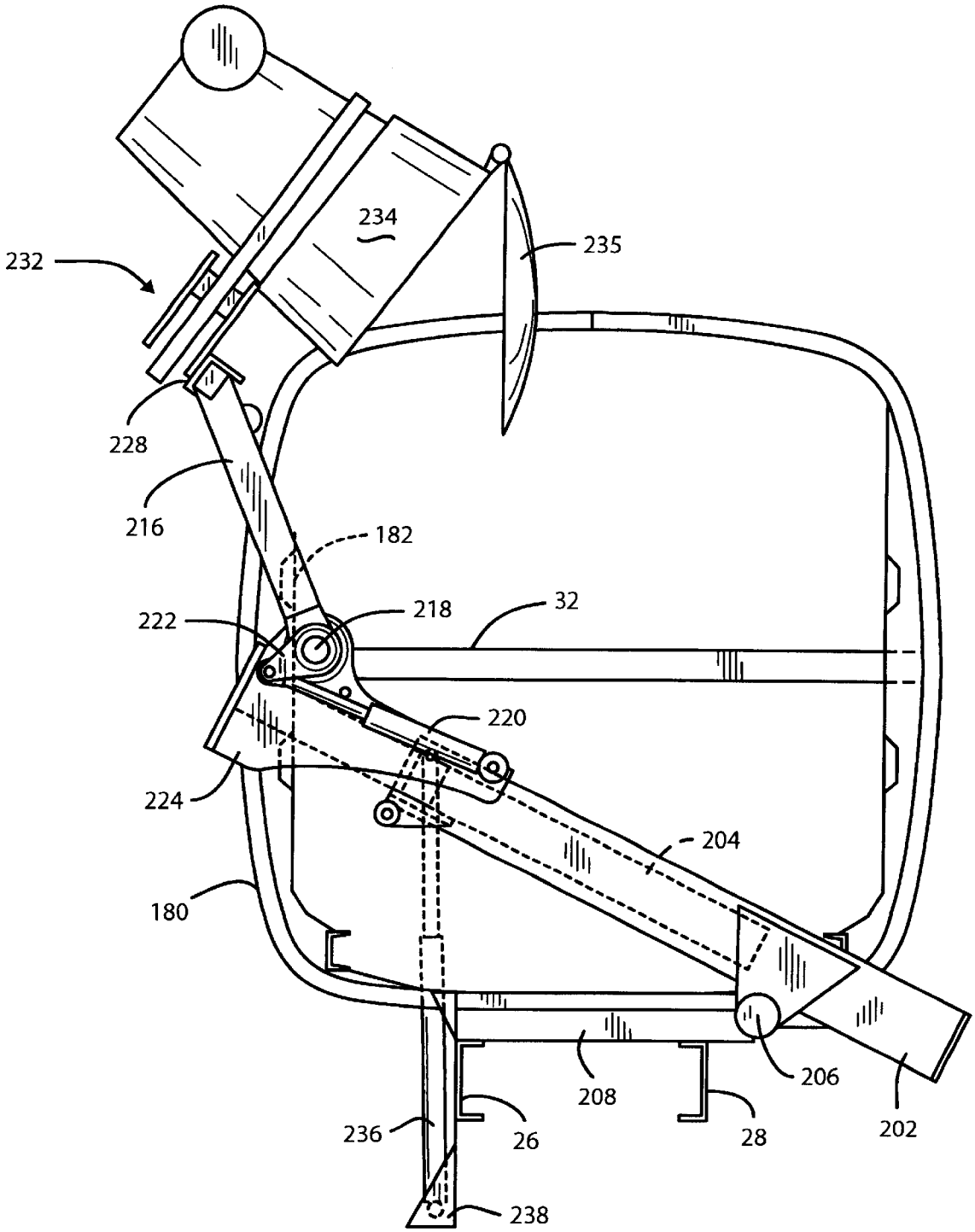

The operation of this embodiment is similar to that of the embodiment described in relation to FIGS. 4*a*–4*c*, 5*a*–5*c* and 6*a*–6*c* in which the extension of the boom and operation of the rider are utilized to approach a container as in FIG. 7*b* and dump cylinder 220 and boom tilt cylinder 236 utilized in the lift and dump operation at 8*b* and 8*c*. The use of the internal cylinder 210 in this embodiment provides a more compact boom arm system.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A system for handling refuse containers comprising:

(a) a support member pivotally mounted on a support base;

(b) an extensible boom including a combination of connected relatively moveable telescoping arm members configured in a manner selected from the group of combinations consisting of an inner arm member moveable relative to a fixed outer arm member and an outer arm member moveable over a fixed inner arm member, said telescoping arm members defining a free end and a relatively fixed end, and a first linear actuator connected to reciprocally operate said boom, said fixed end being mounted on said support base in a manner so as to enable the boom to also pivot vertically, and a second linear actuator connected to raise and lower the free end of the boom;

(c) a generally vertically operable lift and tilt arm wherein said lift and tilt arm is an angled member having a free end that extends beyond the free end of said extensible boom and a fixed end pivotally fixed atop the free end of said extensible boom, said lift and tilt arm being pivotally operable to raise and lower the free end and a third linear actuator connected to pivot said lift and tilt arm;

(d) a generally horizontally disposed container grabber support member fixed to the free end of said lift and tilt arm and extending in cantilevered transverse relation thereto and a slidably mounted rider member carried thereon and a fourth linear actuator connected to said rider for adjusting the location of said rider member reciprocally, linearly along said grabber support member;

(e) a mechanized container grabber including opposed encircling dual grabber arms having opposed digits for seizing and holding a container of interest by converging said arms and digits about a container of interest, said container grabber being carried by said rider member, said grabber arms being disposed in a generally horizontal disposition when said extensible boom and said lift and tilt arm are fully lowered, a plurality of linear actuators for operating said grabber mechanism.

* * * * *